US012404623B2

(12) United States Patent
Jiao

(10) Patent No.: US 12,404,623 B2
(45) Date of Patent: Sep. 2, 2025

(54) LAUNDRY PEDESTAL SYSTEM

(71) Applicant: Rico Jiao, Herndon, VA (US)

(72) Inventor: Rico Jiao, Herndon, VA (US)

( * ) Notice: Subject to any disclaimer, the term of this patent is extended or adjusted under 35 U.S.C. 154(b) by 0 days.

(21) Appl. No.: 18/340,866

(22) Filed: Jun. 25, 2023

(65) Prior Publication Data

US 2024/0426041 A1 Dec. 26, 2024

(51) Int. Cl.
*D06F 39/12* (2006.01)
*D06F 39/08* (2006.01)
*D06F 95/00* (2006.01)

(52) U.S. Cl.
CPC ..... *D06F 39/125* (2013.01); *D06F 39/081* (2013.01); *D06F 95/004* (2013.01)

(58) Field of Classification Search
CPC .... D06F 39/125; D06F 39/081; D06F 95/004; A47L 15/421
USPC ..... 248/673, 678
See application file for complete search history.

(56) References Cited

U.S. PATENT DOCUMENTS 1,771,570 A * 7/1930 Blanchard ..... D06F 1/00 137/247.27
3,106,409 A * 10/1963 Berlin ..... D06F 95/004 301/5.306
3,788,581 A * 1/1974 Rutzick ..... F16M 5/00 248/678
4,243,197 A * 1/1981 Wright ..... D06F 39/12 248/678
4,413,592 A * 11/1983 Jones ..... D06F 39/081 122/504
4,903,723 A * 2/1990 Sublett ..... A47L 15/421 4/251.1
D388,566 S * 12/1997 Reid ..... D32/25
6,585,225 B1 * 7/2003 Lake ..... D06F 39/12 248/346.02
6,895,770 B1 * 5/2005 Kaminski ..... F24F 13/222 62/285
6,923,419 B2 * 8/2005 George ..... F25D 23/00 248/676
6,929,270 B1 * 8/2005 Flagstad ..... B62B 5/0083 280/79.11
7,124,772 B1 * 10/2006 Browning ..... G08B 21/20 220/571

(Continued)

FOREIGN PATENT DOCUMENTS

AU 2013243243 B2 * 1/2018 ..... A47B 91/005
CN 1542208 A * 11/2004 ..... D06F 39/12

(Continued)

OTHER PUBLICATIONS

Machine Translation of DE 102004021881 (Year: 2004).*

*Primary Examiner* — Taylor Morris

(57) ABSTRACT

The present invention relates to a universal laundry pedestal system designed to accommodate various brands and sizes of laundry machines. The system comprises a pedestal frame with four legs, two support surfaces for creating a storage space, and a drainage system including a drainage hole and an optional outlet tube and plug. The system's also includes a custom-fitted laundry hamper which may incorporate ergonomic features such as side handles and rear wheels. This integrated system delivers enhanced utility and efficient water leak management, improving user experience and safety in the laundry room environment.

12 Claims, 6 Drawing Sheets

(56) References Cited

U.S. PATENT DOCUMENTS

| | | | | |
|---|---|---|---|---|
| 7,721,364 | B2 * | 5/2010 | Pearson | A47B 77/08 4/631 |
| 7,748,682 | B2 * | 7/2010 | Hunke | F16M 7/00 248/673 |
| 7,810,782 | B1 * | 10/2010 | Driscoll | D06F 39/125 248/676 |
| 8,341,981 | B2 * | 1/2013 | Kim | D06F 39/125 68/3 R |
| 9,447,841 | B2 * | 9/2016 | Kim | D06F 29/00 |
| 9,499,933 | B2 * | 11/2016 | Deryckere | F16M 13/00 |
| 10,159,396 | B1 * | 12/2018 | Gunn | D06F 39/125 |
| 10,471,585 | B1 * | 11/2019 | Gionta | B25H 1/04 |
| 10,941,947 | B2 * | 3/2021 | Andersson | F24F 13/22 |
| 2010/0243661 | A1 * | 9/2010 | Upham | F24H 9/0094 220/571 |
| 2013/0206246 | A1 * | 8/2013 | Chilcoat | D06F 39/081 137/15.01 |
| 2015/0145392 | A1 * | 5/2015 | Khan | F16M 11/38 312/258 |

FOREIGN PATENT DOCUMENTS

| | | | | | |
|---|---|---|---|---|---|
| CN | 105002700 | A | * | 10/2015 | D06F 39/125 |
| CN | 108396524 | A | * | 8/2018 | D06F 39/125 |
| CN | 111058219 | A | * | 4/2020 | D06F 39/125 |
| CN | 113005724 | A | * | 6/2021 | A47B 83/00 |
| DE | 29914603 | U1 | * | 2/2000 | D06F 39/125 |
| DE | 20101249 | U1 | * | 3/2001 | D06F 39/12 |
| DE | 10327367 | A1 | * | 1/2005 | D06F 39/125 |
| DE | 102004021881 | A1 | * | 12/2005 | D06F 39/12 |
| DE | 202005014026 | U1 | * | 12/2005 | D06F 39/12 |
| DE | 102005008438 | A1 | * | 9/2006 | A47B 91/005 |
| DE | 102011054977 | A1 | * | 5/2013 | D06F 39/125 |
| EP | 1205129 | A1 | * | 5/2002 | A47B 47/042 |
| EP | 1679402 | A2 | * | 7/2006 | A47B 83/045 |
| EP | 3165665 | A1 | * | 5/2017 | |
| JP | 2002035484 | A | * | 2/2002 | D06F 39/125 |
| KR | 20040011980 | A | * | 2/2004 | D06F 39/081 |
| KR | 20050102328 | A | * | 10/2005 | D06F 39/125 |
| KR | 100866461 | B1 | * | 10/2008 | D06F 39/125 |
| KR | 20110095539 | A | * | 8/2011 | D06F 39/125 |

* cited by examiner

LAUNDRY PEDESTAL SYSTEM

FIELD OF INVENTION

The present invention pertains to a universal laundry pedestal system. More specifically, the invention relates to a pedestal capable of elevating laundry machines, incorporating a built-in drain pan, drainage options, storage space, and a custom fitted laundry hamper.

BACKGROUND

Traditionally, the laundry room setup often includes a washing machine and a dryer stacked on top of one another or placed side by side, depending on the space available and the model type. While the common household layout is practical, it presents several limitations and potential hazards, creating a demand for an improved laundry setup system.

Firstly, these laundry machines are often set on the floor or a basic pedestal without any leakage protection. The washing machine, in particular, has a potential for water leakage due to mechanical failures, overloading, or loose hoses. When such leakage occurs, water can pool beneath the machine, causing damage to flooring, inducing mold growth, and even leading to potential accidents due to slipping hazards. Drain pans have been introduced to address this issue, but they generally sit flat on the floor, making water removal difficult and necessitating the movement of heavy laundry machines for access and cleaning.

Secondly, the height at which the laundry machines are traditionally set often results in user discomfort, requiring them to bend or kneel, leading to potential back strain during the loading and unloading process. Existing laundry pedestals offer a solution by raising the height of the machines but are often brand-specific, lacking universality, and they do not typically come equipped with built-in drainage capabilities.

Additionally, while some existing laundry pedestals incorporate drawers for storage, the utilization of this space has been less than optimal. These drawers are usually designed for storing laundry supplies, rather than providing a means of temporary storage for laundry itself. As a result, another space or piece of furniture is often required for a separate laundry hamper, adding to the clutter in the laundry room.

Further, the pedestals' stationary nature can lead to instability of the machine during operation due to the lack of vibration damping features, potentially causing machine slippage and consequent damage or harm.

In the face of these issues, there exists a need for a universal laundry pedestal that can accommodate various laundry machines, providing enhanced height for user comfort, integrated drainage for potential leaks, efficient usage of the storage space beneath the machine, and stability during machine operation. Such a solution would serve to consolidate multiple elements into one product, reducing the need for additional purchases and promoting more efficient use of space in the laundry room. It would also provide a way to safely and easily handle water leaks, protecting household infrastructure and improving user safety. The provision of a custom fitted laundry hamper that can be housed within the pedestal itself would optimize the available space and provide convenience to the user.

It is within this context that the present invention is provided.

SUMMARY

The present invention is directed to a universal laundry pedestal system that aims to overcome the aforementioned drawbacks associated with traditional laundry setups.

A key aspect of the invention includes a universal laundry pedestal comprising a frame with four legs that serves to elevate a laundry machine. The pedestal includes a flat supporting surface having raised edges around its top side for securely accommodating a laundry machine, the raised edges also prevent water leaks. To address water leakage concerns, the laundry pedestal incorporates a drainage hole. This design not only catches potential water leaks but also facilitates easy removal of water without needing to move the laundry machine, thus mitigating the risk of damage and safety hazards posed by leaked water.

Additionally, the laundry pedestal includes a storage space beneath the upper support surface, featuring an open side and a lower support surface to accommodate a custom-fitted laundry hamper. This hamper, provided as part of the kit, can be pulled out like a drawer. The hamper may include wheels for easier movement when rolled on the floor. This novel arrangement maximizes the utility of the storage space, simultaneously providing a convenient system for transporting laundry.

The top support surface is completely flat and can be inclined via the adjustable legs towards a drainage hole to ensure effective water drainage. The drainage hole may be coupled to a plastic outlet tube via a watertight seal on the underside of the support surface. The water can then be diverted to a nearby floor drain or large container to contain excess water.

The invention also introduces an optional plug for the drainage hole, allowing the collected water to be drained when necessary. This plug may be configured for removal from the underside of the top support surface, eliminating the need for reaching under the laundry machine to drain the water.

To prevent machine slippage, the square-shaped top surface may be fitted with four leg stand mats made from a softer material having vibration damping qualities. These mats may have high friction top surfaces for added stability.

Another feature that may be used for vibration damping is a set of cross bars underneath the top support shelf. This cross bar is welded onto the bottom surface of the shelf and adds additional support that keeps the shelf from vibrating excessively during the laundry machines use, especially during the spin cycle.

Furthermore, the pedestal frame may include adjustable legs to compensate for uneven flooring or varying height requirements, providing an adaptable solution for different laundry room configurations.

By consolidating several functions and advantages into one system, the present invention substantially improves upon prior art, providing a comprehensive, efficient, and user-friendly solution for laundry machine setups.

BRIEF DESCRIPTION OF THE DRAWINGS

Various embodiments of the invention are disclosed in the following detailed description and accompanying drawings.

Figure 1:
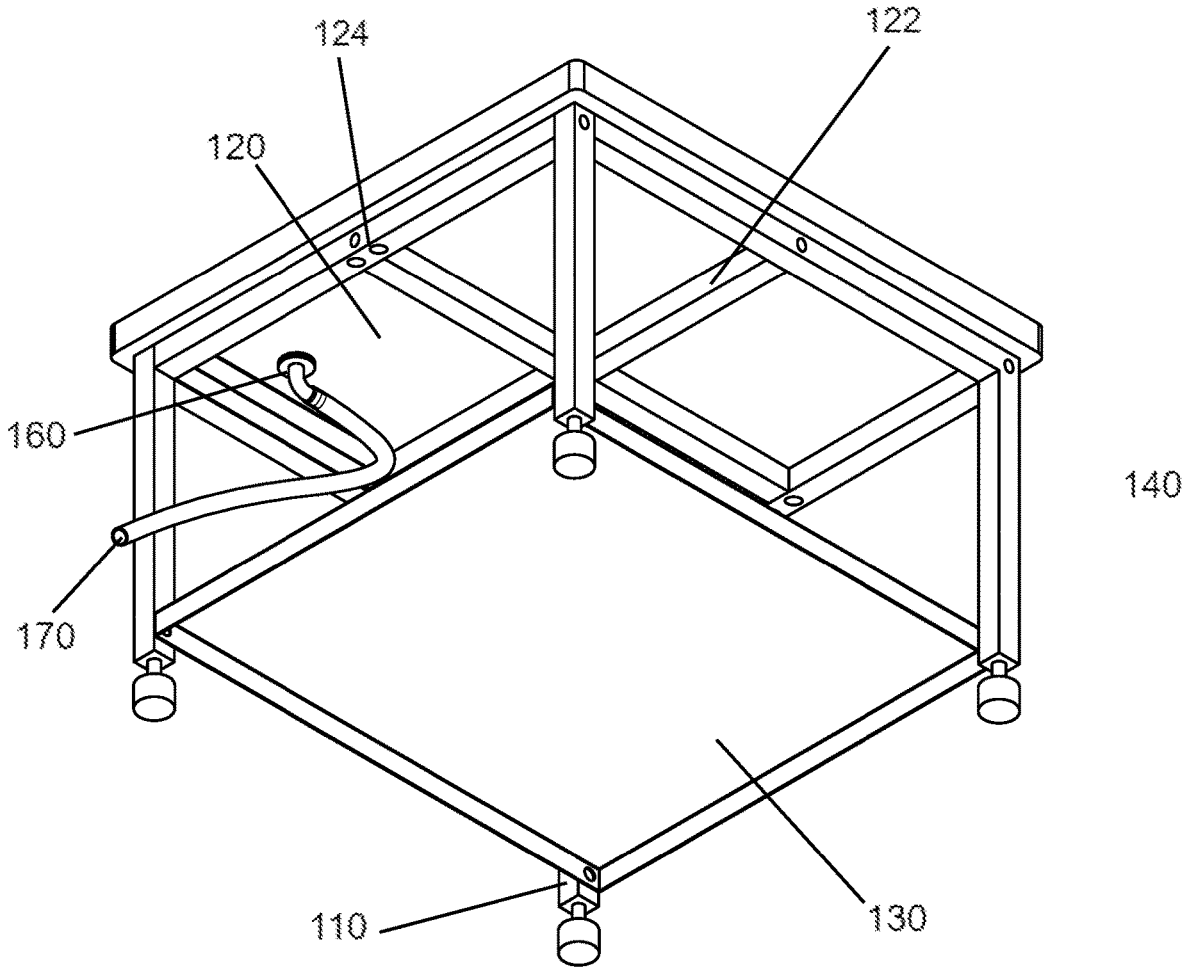
FIG. 1 is an isometric perspective view from below of the universal laundry pedestal system, showing the frame with adjustable legs, the upper and lower support surfaces, the storage space, and the drainage system comprising a hole and an outlet tube.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention.

As used herein, the term "and/or" includes any combinations of one or more of the associated listed items.

As used herein, the singular forms "a," "an," and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The terminology used herein is for the purpose of describing particular embodiments only and is not intended to be limiting.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

FIG. 1 illustrates an isometric perspective view of the universal laundry pedestal system 100, seen from a lower angle. The primary frame comprises four legs 110. The legs 110 may be adjustable, allowing the pedestal to accommodate uneven flooring conditions or varying height requirements. The legs may be four independent legs, or may be formed into two "C" shaped structures, each comprising two legs. This configuration makes the frame stronger, the "C" shapes are oriented in parallel to the rolling axis of a front load washing machine, helping to keep the pedestal from swaying side to side.

Formed within this frame, there are two support surfaces 120, 130, which create a storage space 140. This configuration is advantageous as it maximizes utility while minimizing the footprint of the system. Nestled into a corner of the top support surface 120, a drainage hole 150 is visible. This hole is sealed in a watertight manner by seal 160 and connected to an outlet tube 170. The strategic positioning of the outlet tube 170 ensures that any water leaking into the drainage hole 150 is safely directed away from the storage space 140, protecting laundry and preventing potential water damage. Leaked water can be diverted to a floor drain or a separate water container.

A set of cross bars 122 are provided underneath the upper support shelf 120. The cross bars 122 being welded onto the bottom surface of the support 120 to provide additional support that keeps the shelf from vibrating excessively during the laundry machine use. This not only increases vibration damping, but the overall structural strength and stability of the pedestal.

The pedestal may also be provided with a coupling element 124 for affixing adjacent pedestals to one another in a modular fashion.

Figure 2:
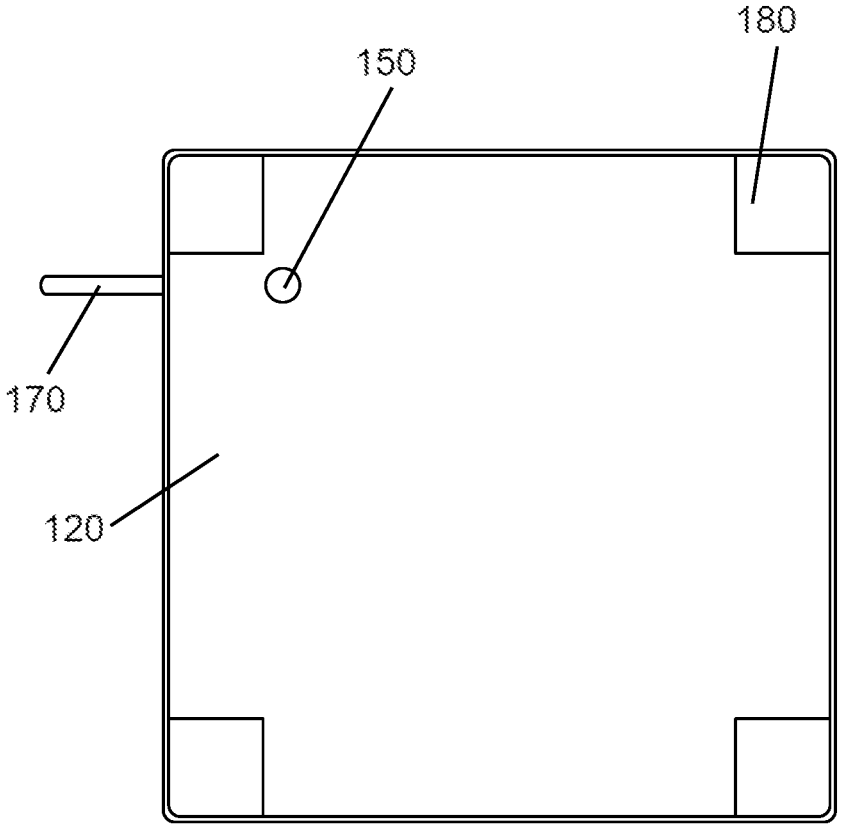
FIG. 2 is a plan view of the top of the laundry pedestal, illustrating the flat, square support surface with leg stand rubber mats at each corner, and the corner-located drainage hole connected to the outlet tube.

FIG. 2 presents a plan view of the top of the laundry pedestal 100. The top support surface 120 is characterized by a flat, square configuration, providing a stable base for a variety of laundry machine sizes and designs. A drainage hole 150 is strategically placed in a rear corner to maximize the usable surface area. The inclusion of leg stand mats 180 at each corner of the top support surface 120 introduces an additional benefit of vibration damping and increased friction to prevent the laundry machine from sliding, enhancing overall stability and safety. (Please also mention the cross bars and how they add vibration damping and strength. The outlet tube 170, extending from the rear of the pedestal 100, further emphasizes the robust leak management system.

Figure 3:
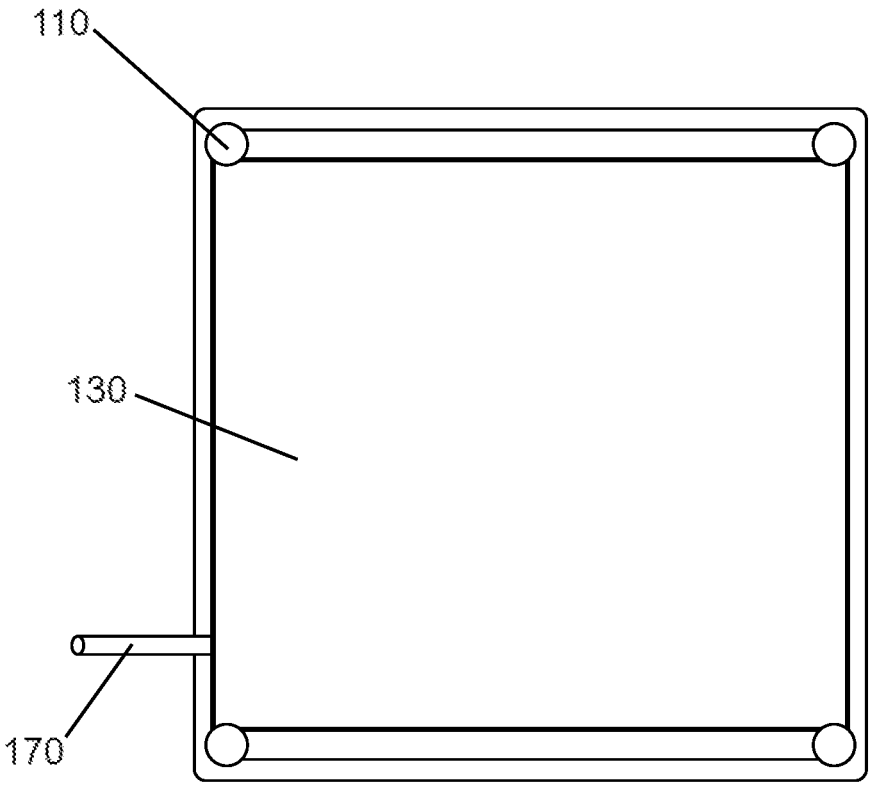
FIG. 3 is a plan view of the bottom of the laundry pedestal, highlighting the adjustable legs and the positioning of the outlet tube.

FIG. 3 demonstrates a plan view of the bottom of the laundry pedestal 100, highlighting the positioning of the adjustable legs 110 at the respective corners beneath the lower support surface 130. The outlet tube 170 extends from the rear, reiterating its function as an essential water management tool.

Figure 4:
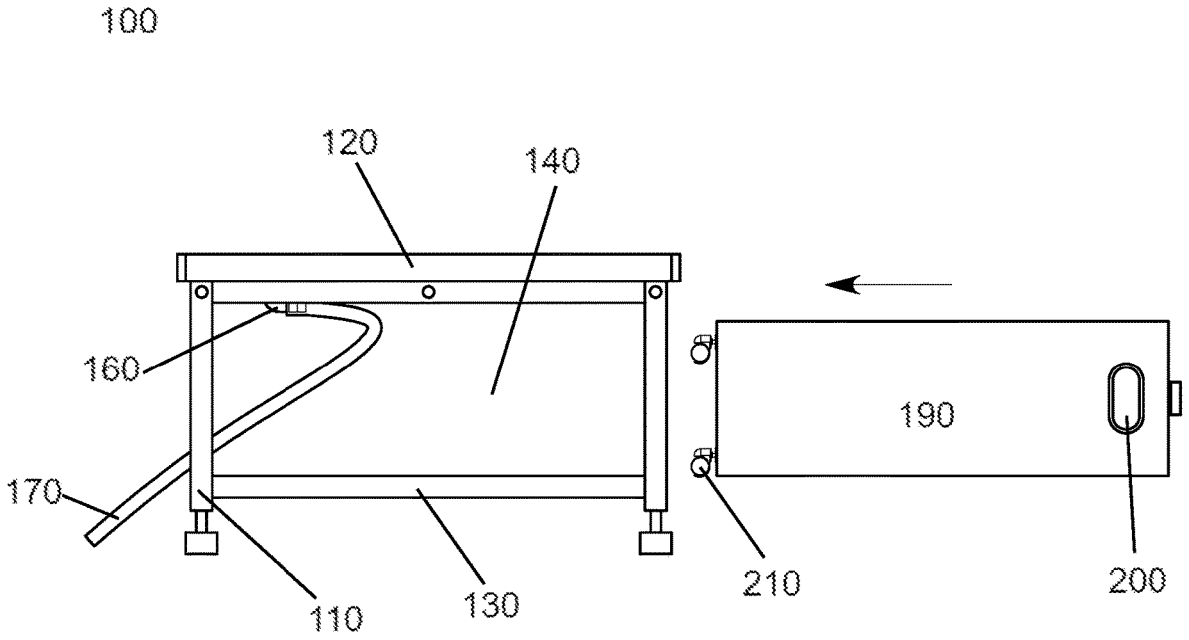
FIG. 4 is a side view of the laundry pedestal with a custom-fitted laundry hamper ready for insertion into the storage space, featuring side handles and rear/bottom wheels on the hamper.

In FIG. 4, a side view of the laundry pedestal 100, the custom-fitted laundry hamper 190 is readied at the opening of the storage space 140, prepared to slide smoothly between the two support surfaces 120, 130. Features such as side handles 200 and rear/bottom wheels 210 enhance user interaction, facilitating ease of movement and comfort, especially when the hamper is fully loaded. The outlet tube 170 is again visible.

Figure 5:
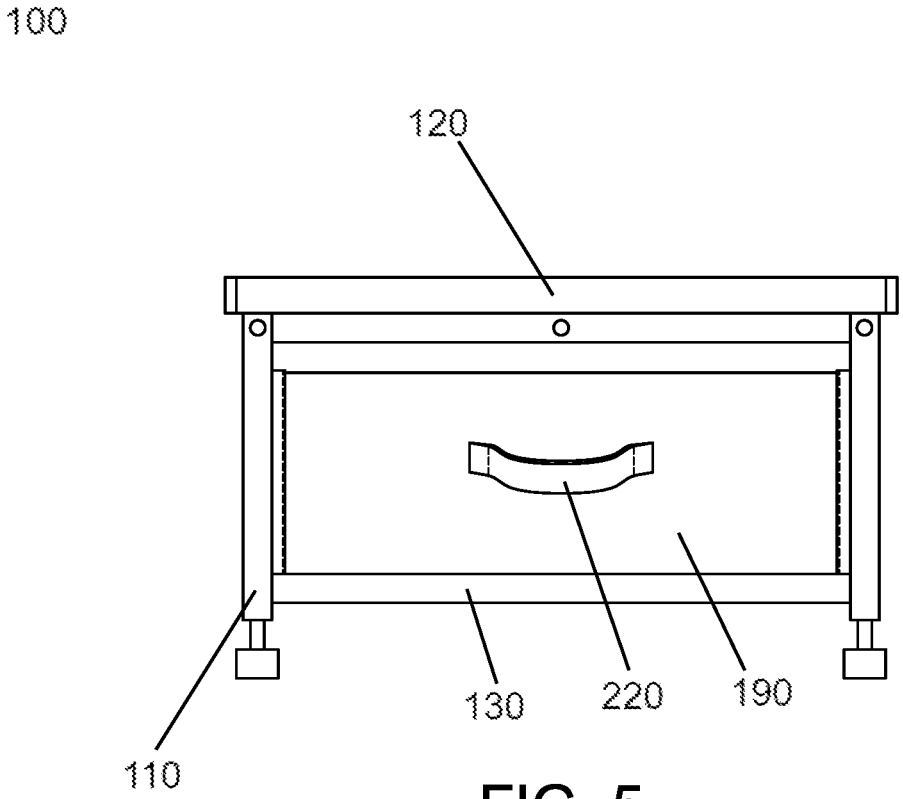
FIG. 5 is a frontal view of the laundry pedestal with the laundry hamper fitting snugly into the storage space, demonstrating the user-focused design with a front handle on the hamper for easier pull out.

FIG. 5 reveals a frontal view of the laundry pedestal 100 with the laundry hamper 190 installed within the storage space 140. The hamper 190 aligns with the front of the pedestal 100, providing a neat and visually appealing appearance. The front handle 220 enables easy access and removal of the hamper 190.

Figure 6:
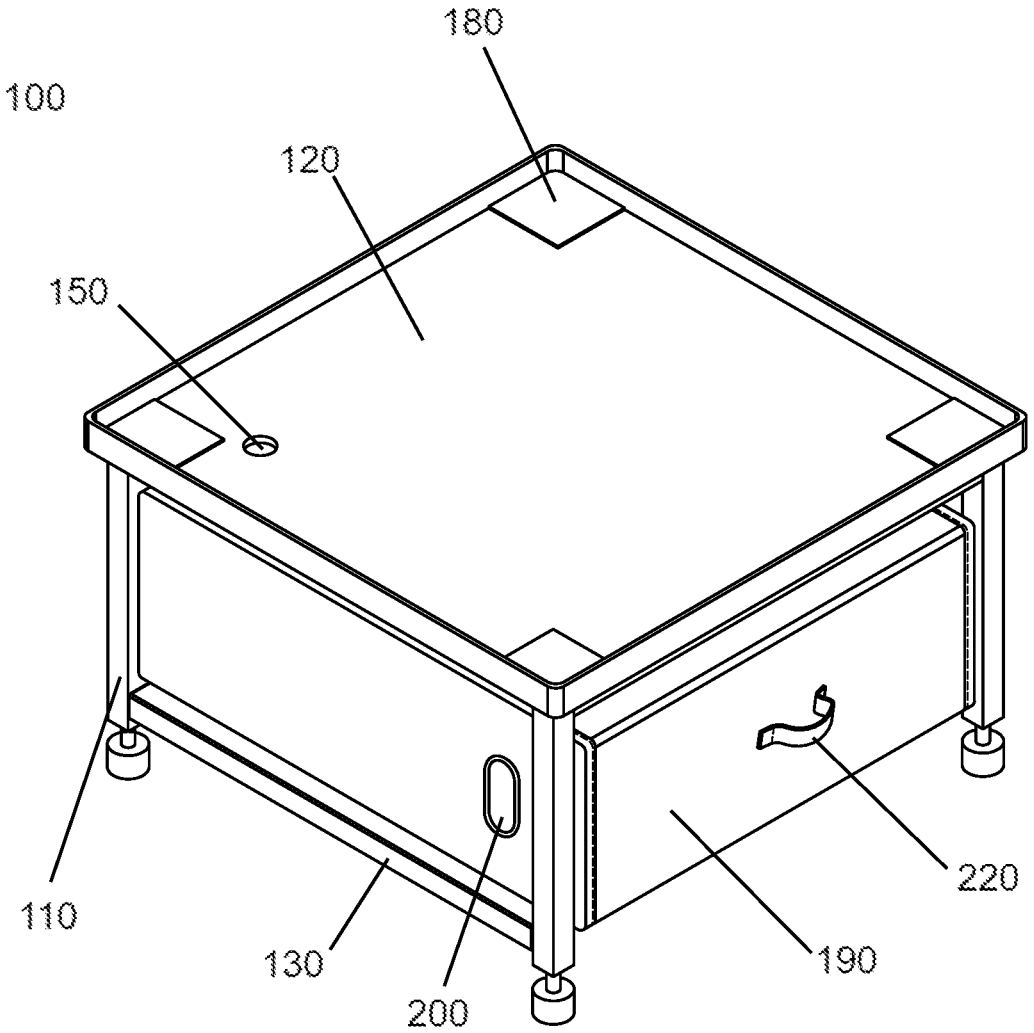
FIG. 6 is an isometric perspective view of the laundry pedestal with the laundry hamper installed in the storage space, encapsulating the efficient, integrated design of the system.

Lastly, FIG. 6 provides an isometric perspective view of the laundry pedestal 100, showcasing the hamper 190 secured within the storage space 140.

These figures, along with the accompanying descriptions, highlight the primary components and innovative features of the universal laundry pedestal system. It should be understood that these illustrations serve to exemplify the invention's application and are not intended to limit the scope of the invention to the specific embodiments shown.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the laundry management system have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A laundry pedestal system, comprising:

a drawer-shaped laundry hamper; and a universal laundry pedestal comprising a frame having four legs and an upper support surface configured to elevate a laundry machine, said surface having raised edges and a drainage hole formed therein, the pedestal further comprising a lower support surface positioned between the legs and beneath the upper support surface within the frame, the lower support surface forming an open-ended storage space shaped and sized to accommodate the laundry hamper;

wherein the lower support surface forms the floor of the open-ended storage space and is raised above floor level; and further comprising a set of cross bars underneath the upper support surface, the set of cross bars being welded onto a bottom surface of the upper support surface to provide additional support that keeps the upper support surface from vibrating excessively during the laundry machine use.

2. The laundry pedestal system of claim 1, further comprising a plastic outlet tube attached to said drainage hole via a watertight seal, the outlet tube being configured to direct leaked water away from the universal laundry pedestal.

3. The laundry pedestal system of claim 1, wherein said upper support surface is substantially flat.

4. The laundry pedestal system of claim 1, wherein said laundry hamper includes wheels for easier rolling around when it is upright.

5. The laundry pedestal system of claim 1, further comprising a removable plug configured for the drainage hole, enabling manual drainage of collected water from the upper support surface.

6. The laundry pedestal system of claim 5, wherein said plug is removable from the underside of the upper support surface, eliminating the need for reaching under the laundry machine to drain water.

7. The laundry pedestal system of claim 1, wherein the legs of said frame are adjustable to compensate for uneven flooring or varying height requirements.

8. The laundry pedestal system of claim 7, wherein said adjustable legs are configured to incline the top surface in a direction towards said drainage hole to facilitate water drainage.

9. The laundry pedestal system of claim 1, further comprising four leg stand mats provided on respective corners of the upper support surface, made from a material with vibration damping qualities.

10. The laundry pedestal system of claim 9, wherein the leg stand mats further comprise a high friction top surface to prevent sideways slippage of any laundry machine resting atop them.

11. The laundry pedestal system of claim 1, wherein the legs are formed into two structures, each comprising two vertical legs connected at right angles by a horizontal bar.

12. The laundry pedestal system of claim 1, further comprising a coupling element positioned underneath the upper support surface for affixing adjacent pedestals to one another in a modular fashion.

* * * * *